US006800598B1

(12) United States Patent
Waeschenbach et al.

(10) Patent No.: US 6,800,598 B1
(45) Date of Patent: Oct. 5, 2004

(54) COMPOSITION FOR USE IN A DISHWASHING MACHINE

(75) Inventors: Guido Waeschenbach, Oakland, NJ (US); Ralf Wiedemann, Griesheim (DE); Enric Carbonell, Barcelona (ES); Ludwig Hertling, Biblis (DE); Natascha Wolf Daschner, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 09/744,726

(22) PCT Filed: Jul. 29, 1999

(86) PCT No.: PCT/TR99/00034

§ 371 (c)(1),
(2), (4) Date: Mar. 18, 2002

(87) PCT Pub. No.: WO00/06688

PCT Pub. Date: Feb. 10, 2000

(30) Foreign Application Priority Data

Jul. 29, 1998 (DE) ..... 198 34 182

(51) Int. Cl.[7] ..... C11D 17/00; B08B 9/20

(52) U.S. Cl. ..... 510/224; 510/446; 510/475; 134/25.2

(58) Field of Search ..... 510/224, 446, 510/475; 134/25.2

(56) References Cited

U.S. PATENT DOCUMENTS 3,924,622 A * 12/1975 Brooke ..... 128/260
4,082,678 A 4/1978 Pracht et al. ..... 252/8.6
4,801,636 A * 1/1989 Smith et al. ..... 524/236
4,972,017 A * 11/1990 Smith et al. ..... 524/46
5,360,567 A * 11/1994 Fry et al. ..... 510/298
6,264,985 B1 * 7/2001 Cremer ..... 424/473

(List continued on next page.)

FOREIGN PATENT DOCUMENTS

DE 230917 7/1908
DE 2 065 153 10/1972 ..... C11D/17/00

(List continued on next page.)

OTHER PUBLICATIONS

Abstract: JP 60–141705 dated Jul. 26, 1985.
Abstract: JP 61–28440 dated Feb. 8, 1986.
Abstract: JP 61–28441 dated Feb. 8, 1986.
Abstract: JP 61–28596 dated Feb. 8, 1986.
Abstract: JP 61–28597 dated Feb. 8, 1986.
Abstract: JP 61–28598 dated Feb. 8, 1986.
Abstract JP 50–77406 dated Jun. 24, 1975.

*Primary Examiner*—Lorna M. Douyon
(74) *Attorney, Agent, or Firm*—Akin Gump Strauss Hauer & Feld, L.L.P.

(57) ABSTRACT

Composition for use in a water tank in the kitchen or sanitary sectors characterized by a basic composition essentially evolving its function following addition to a first water filling of the water tank, in the form of a tablet and at least one particle, with at least one core, which comprises at least one substance evolving its function essentially following an at least partial emptying of the first water filling from the water tank Ad and the inflow of fresh water and a covering substantially completely surrounding the core or cores comprising at least one compound, whose solubility increases with decreasing concentration of a specific ion in the surrounding medium, the at least one particle being so arranged in or on the tablet that the surface of the particle or particles is at most only partly in direct contact with the surface of the basic composition surrounding the same and the concentration of the specific ion in the local environment of the particle or particles is sufficiently high up to a substantially complete dissolving of the tablet in order to prevent a substantial dissolving of the covering or a substantial detachment of the covering from the core or cores.

47 Claims, 3 Drawing Sheets

U.S. PATENT DOCUMENTS

Figure 1:
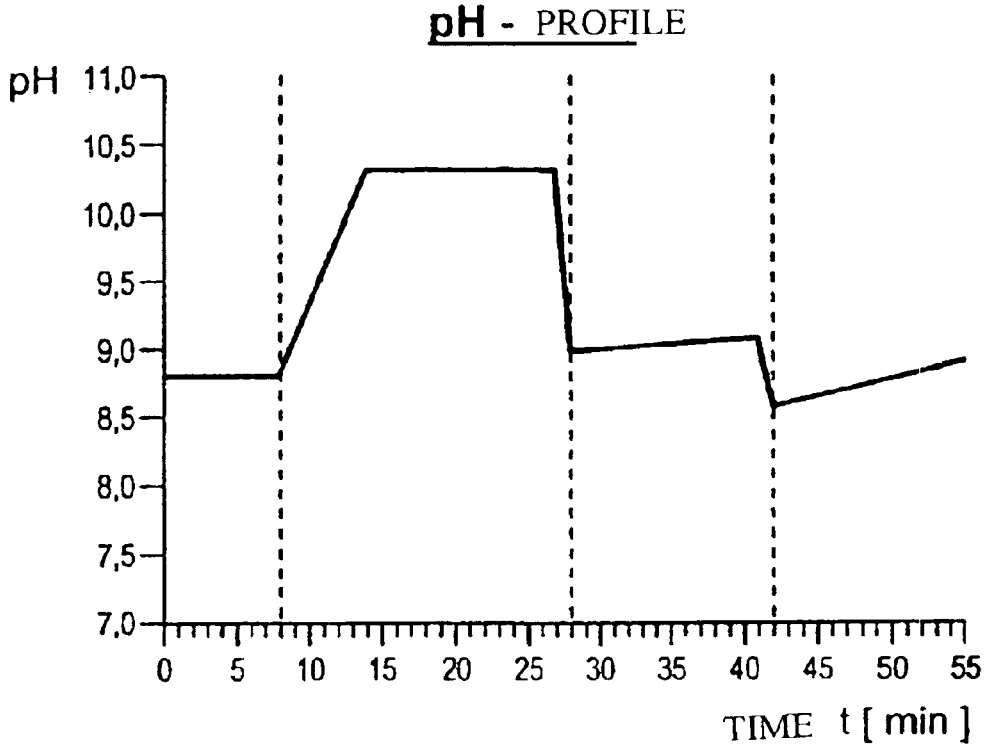

| | | | | |
|---|---|---|---|---|
| 6,274,538 | B1 * | 8/2001 | Addison | 510/24 |
| 6,303,561 | B1 * | 10/2001 | Painter | 510/446 |
| 6,358,911 | B1 * | 3/2002 | Metzger-Groom | 510/446 |
| 6,514,429 | B1 * | 2/2003 | Waschenbach et al. | 252/181 |

FOREIGN PATENT DOCUMENTS

| | | | | |
|---|---|---|---|---|
| EP | 0 284 191 | B1 | 9/1988 | B65D/65/38 |
| EP | 0 284 334 | A2 | 9/1988 | C11D/17/00 |
| EP | 0 423 487 | A2 | 4/1991 | C11D/3/12 |
| EP | 0 481 547 | A1 | 4/1992 | C11D/17/00 |
| GB | 1 307 387 | | 2/1973 | C11D/11/00 |
| JP | 09175992 | A2 * | 7/1997 | |
| WO | WO 92/20774 | A1 * | 11/1992 | |
| WO | WO95/29982 | | 11/1995 | C11D/17/00 |
| WO | WO 99/27067 | A1 * | 6/1999 | |

* cited by examiner

COMPOSITION FOR USE IN A DISHWASHING MACHINE

The present invention relates to a composition for use in a dishwashing machine and a process for the use thereof.

Although modern dishwashing machines in most cases have numerous different washing programs, which differ with regards to the duration and temperature of the individual washing cycles, all washing programs essentially consist of the following basic steps: preliminary washing cycle, main cleaning cycle, one or more intermediate rinsing cycles, a clear rinsing cycle and drying. Whereas the machine dishwashing agent for bringing about the cleaning action is added at the start of the main cleaning cycle, during the clear rinsing an cycle special agents are used, e.g. clear rinsing agents. Clear rinsing agents are intended to ensure that when washing with water water droplets are not left behind on the washed articles which, after drying on, leave behind marks of substances dissolved/dispersed in the droplets.

These two functionalities, namely the cleaning action of the machine dishwashing agent and the described function of a clear rinsing agent, have hitherto been brought about using two separate charging or dosing devices and products charged or dosed at different points during the dishwashing cycle.

Apart from the use of clear rinsing agents, there is still a need for further substances evolving their activity during the washing or rinsing cycle, such as e.g. an antibacterial activity (e.g. cationic compounds or triclosan), silver protection agents (e.g. benzotriazole), an odorous action (fragrances, perfume), bleaching action/disinfection (chlorine bleaches), odour masking (e.g. polyvinylpyrrolidone), anti-coating agents and enzymes for additional purposes (e.g. lipase for removing grease and fat deposits in the dishwasher). However, modern dishwashers have no suitable charging systems for this purpose.

The aim of the present invention was consequently to combine in a single function the cleaning function and the function or functions of the substance or substances to be added during the clear rinsing cycle with a constant efficiency compared with the results obtainable with a separate charging or to permit the charging of substances other than the clear rinsing agent in the clear rinsing cycle.

DE-OS 20 65 153 and 20 07 413 disclose detergent blanks for use as detergents, in which it is inter alia provided that two components having a different functionality are combined. The structure comprises an enveloping shell, which is e.g. formed from two shell halves comprising a cleaning agent, as well as a cavity enclosed by the shells and which contains additives such as softeners, brighteners, etc.

British patent 1 390 503 discloses a liquid detergent containing capsules, which are insoluble in the composition, but release their content if the composition is diluted with water. This objective is achieved in that the capsules are coated with a substance having a poor solubility in water solutions with high ionic strength, but becoming soluble if the ionic strength is reduced by dilution. It is pointed out that this procedure can be used to incorporate materials in the liquid cleaning agent, which are unstable in the latter or would produce an instability if added directly. It is also proposed that this procedure be used in order to delay the release of a specific substance. Reference is made to use in machine dishwashing agents and it is proposed for the encapsulation of tribromosalicylanilide in order to stabilize the latter. The encapsulated material is released within two minutes following the dilution of the cleaning agent with water, i.e. in the main cleaning cycle.

U.S. Pat. No. 4,082,678 describes a fabric conditioning product comprising a closed container containing a releasable agent, which is used to make water-insoluble or non-dispersible an inner container located in the container and which is normally water-soluble or water-dispersible, the inner container is containing a fabric conditioner. The inner container is made from a substance, whose solubility in water is highly dependent on the ionic strength or the pH-value of the medium and the agent used for rendering the inner container insoluble is an agent for controlling the pH-value or ionic strength.

Japanese patent applications KOKAI 60-141705, 61-28440, 61-28441, 61-28596, 61-28597 and 61-28598 describe processes for the production of pH-sensitive microcapsules for use in detergents. The pH-sensitive coating is a copolymer of the following monomers:

A) at least one basic monomer of formula I:

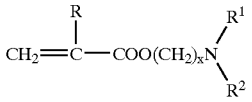

(I)

in which R is hydrogen or a methyl group, $R^1$ and $R^2$ in each case an alkyl group with 1 to 3 carbon atoms and x an integer from 1 to 4, B) at least one monomer, which is insoluble or difficultly soluble in water and C) at least one water-soluble monomer.

It is stated that the polymers described are insoluble at a pH-value of 9.5 or higher and are soluble at a pH-value of 8.5 or lower. A description is given of different ingredients of cleaning agent compositions, which can be successfully and usefully coated with the polymers described. The aim of the invention described therein is that the substances only evolve their function during the rinsing cycle, protect the same up to the start thereof and then immediately release it. The use for dishwashing machines is not described.

A disadvantage of the solution described in these Japanese patent applications is that the enveloped particles are in direct contact with non-alkaline washing water at the start of the washing cycle which can lead to a partial dissolving of the protective envelope.

Japanese patent KOKAI 50-77406 discloses a washing aid surrounded by a water-soluble envelope obtained by mixing polyvinyl acetal dialkyl aminoacetate and at least one organic acid, which is solid at ambient temperature. This protective envelope serves to protect the washing aid during the main washing cycle and release it during rinsing cycles. The described compound reacts to a change of the pH-value between the main washing cycle and the rinsing cycle. The correspondingly enveloped particles are mixed with conventional pulverulent detergent. Here again the disadvantage of a possible partial dissolving of the protective envelope at the start of the washing cycle occurs.

European patent applications EP 284 191 A2 and 284 334 A2 disclose a water-soluble polymer film for the release of washing additives in the rinsing cycle of washing machines which, during the normal washing cycle, remains intact over a typical temperature range and rapidly dissolves in the rinsing cycle. It is pointed out that although the use of pH-sensitive coatings is known, said films are normally temperature-sensitive, so that they are not reliably stable during the different temperatures occurring in the washing cycle. The solution proposed is a pH-dependent material (which undesirably also has a positive temperature-dependent dissolving behaviour), which is combined with a material having a negative temperature-dependent dissolving behaviour. This combination is intended to guarantee that the coatings do not dissolve at the high temperatures at the start of the washing cycle (particularly the very high temperatures occurring in American machines). No reference is made to a use for machine dishwashing agents.

European patent application EP 481 547 A1 discloses multilayer machine dishwashing agent tablets with a core, a separating layer surrounding the core and an outer layer for the sequential release of the ingredients of the different layers. The aim of this tablet is to solve two different problems, namely 1) incompatible materials can be formulated together in a single tablet and released at different times in order to prevent mutual influencing and 2) compositions intended to evolve their functions at different times can be formulated in a single tablet.

An important disadvantage of this prior art is that for initiating the dissolving of the enveloping layer the temperature and/or in particular the contact time with the washing solution is used as the initiating factor, i.e. temperature-sensitive materials are used for the envelope material. As the temperature/time gradient in dishwashing machines can vary very widely as a function of the selected program, it is difficult, if not impossible, to select a material for the envelope which is usable for all possible programs of modern dishwashing machines. EP 481 547 A1 (p 7, lines 37 to 43) admits that the choice of the material of the enveloping layer must take account of equipment and program-specific details. Thus, the practical usability of the described products is significantly limited.

PCT application WO 95/29982 discloses a machine dishwashing agent with a delayed release of a clear rinsing agent in the form of a nonionic surfactant, which forms together with an inorganic builder salt a core particle, which is provided with a wax-like envelope in order to ensure the delayed release This envelope is a substance which does not melt at the operating temperatures encountered in the cleaning cycle, but which so gradually chemically disintegrates under alkaline pH-values that there is still left at the end of the main cleaning cycle an active clear rinsing agent quantity which is transferred into the clear rinsing cycle.

It is disadvantageous that the envelope is rendered soluble by chemical saponification under alkaline pH-values, so that the time at which the clear rinsing substance is released from the core is a function both of the temperature and the length of the main cleaning cycle. The patent application provides no teaching for the formulation of a product with which it is possible to release the clear rinsing agent only when the clear rinsing cycle arrives in all washing programs of any machine type. In addition, the core ingredient active as the clear rinsing agent is a nonionic surfactant, which is absorbed on an inorganic builder salt. This leads to inferior clear rinsing results, particularly with respect to marks on glass. The product is finally a mixture of granular detergent and granular clear rinsing agent particles.

In view of the prior art, the problem of the present invention is to provide a composition usable for most rinsing/washing programs of different dishwashing machine types and in each of these cases the substance or substances having only to evolve their action in the clear rinsing cycle are only released at the earliest at the start of the clear rinsing cycle. The aim is to achieve this without restricting the choice of the cleaning agents used, the substance or substances used for the clear rinsing cycle and other ingredients of the composition.

According to the invention this problem is solved with a solution characterized by a basic composition evolving its function essentially in the main cleaning cycle of the dishwashing machine; as well as at least one particle, with at least one core incorporating at least one substance, which evolves its function essentially in the clear rinsing cycle of the dishwashing machine and an envelope substantially completely surrounding the core or cores incorporating at least one compound, whose solubility increases with decreasing concentration of a specific compound in the surrounding medium. Agents are provided so that at the start of the clear rinsing cycle a significant dissolving of the envelope or a significant detachment of the envelope from the core or cores is prevented.

In an advantageous embodiment the concentration of the specific compound in the local environment of the particle or particles is sufficiently high up to the start of the clear rinsing cycle so that up to this time there is no significant dissolving of the envelope or significant detachment of the envelope from the core or cores.

Preferably the particle or particles are coated with a substance which, substantially independently of the concentration of the specific compound in the surrounding medium, dissolves or separates during the main rinsing cycle of the dishwashing machine.

The basic composition is preferably in the form of a tablet.

An embodiment of the invention proposes that the at least one particle is so placed in or on the tablet that the concentration of the specific compound in the local environment of the particle or particles is sufficiently high up to the complete dissolving of the tablet to prevent a significant dissolving of the envelope or a significant detachment of the envelope from the core or cores.

Preferably the particle or all the particles are received in at least one tablet cavity completely surrounded by the basic composition.

The at least one cavity can receive one or more particles having alone or together essentially the same volume as the cavity.

Preferably the at least one cavity has a larger volume than the or all the particles received in the particular cavity.

In an alternative of the invention the particle or particles are arranged loosely in the cavity interior.

In another alternative the particle or particles are fixed, preferably by an adhesive, in the cavity interior.

In a further embodiment the cavity is positioned substantially centrally in the tablet interior.

The invention also proposes that the tablet has a single, substantially spherical cavity.

According to the invention the cavity receives a single, substantially spherical particle, whose external diameter is smaller than the internal diameter of the cavity.

According to another embodiment the or all the particles are received in at least one cavity of the tablet, which is only partly surrounded by the basic composition.

Preferably the cavity is a depression in one of the surfaces of the tablet in which the particle or particles are at least partly received.

In a preferred embodiment the particle is so received in the cavity or depression that it does not project over the surface or surfaces of the tablet.

A special embodiment of the invention proposes that the cavity or depression only contains a single particle, whose volume and shape in the vicinity of the cavity or depression substantially coincides with the volume and shape of the cavity or depression and substantially completely fills the same.

Preferably the cavity or depression is parallel to one of the surfaces to which it opens or in which it is located and has a substantially circular cross-sectional surface.

The invention also proposes that the cavity or depression opens to the surface or surfaces only to the extent that the particle or particles received therein cannot pass through the opening or openings of the cavity or depression.

It is inventively preferred for the particle or particles to be loosely arranged in the cavity or depression.

In a further alternative the particle or particles are fixed in the cavity or depression, preferably by an adhesive.

According to an embodiment of the invention the basic composition incorporates at least one composition chosen from the group comprising machine dishwashing agent composition, water softener composition and washing intensifier composition.

In a preferred embodiment of the invention the envelope incorporates at least one compound which for the concentration of the specific compound at the end of the main cleaning cycle of the dishwashing machine is not or is only slightly soluble and at the concentration of the specific compound in the clear rinsing cycle has such an adequate solubility that in the clear rinsing cycle it is so substantially dissolved or detached from the core or cores that an at least partial escape of the core material into the clear rinsing cycle medium is possible.

Preferably the solubility of the compound increases with decreasing $OH^-$ ionic concentration and therefore decreasing pH-value in the surrounding medium.

In particularly preferred manner the compound at a pH-value above 10 has little or no solubility and at a pH-value below 9 has an adequate solubility to ensure a substantially complete dissolving or detachment from the core or cores in the clear rinsing cycle, so that an at least partial escape of the core material into the clear rinsing cycle medium is possible.

Preferably the compound incorporates a polymer, preferably a pH-sensitive polymer, which comprises at least one repeat unit, which has at least one basic function, which is not part of the polymer backbone chain.

In a preferred embodiment the polymer comprises at least one repeat unit, which is based on a compound selected from the group comprising vinyl alcohol derivatives, acrylates or alkyl acrylates, which have said basic function.

According to the invention the polymer is a carbohydrate functionalized with said basic function.

The aforementioned basic function is preferably an amine and in particularly preferred form a secondary or tertiary amine.

In a preferred alternative the repeat unit is based on a compound with the following formula III:

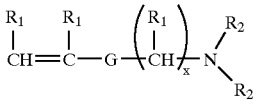

(III)

in which G is a linking group selected from —COO—, —OCO—, —CONH—, NHCO—, —NHCONH—, —NHCOO—, —OCONH—or —OCOO—, $R_1$, independently of one another, is hydrogen or an alkyl group with 1 to 3 carbon atoms, $R_2$ independently of one another, hydrogen or an alkyl group with 1 to 5 carbon atoms and x is an integer from 1 to 6.

Preferably the repeat unit is based on a compound with the following formula IV:

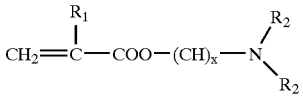

(IV)

in which $R_1$, independently of one another, is hydrogen or an alkyl group with 1 to 3 carbon atoms, $R_2$, independently of one another, is hydrogen or an alkyl group with 1 to 5 carbon atoms and x is an integer from 1 to 6.

In a further embodiment the basic function is an imine or a basic, aromatic N-containing group, preferably a pyridine group or an imidazole group.

In a further embodiment the pH-sensitive polymer is derived from chitosan.

The invention finally proposes that the compound incorporates K-carrageenan.

In a special embodiment of the invention the core or cores comprise at least one material selected from the group constituted by surfactants, antibacterial compositions, silver protection agents, fragrances, bleaches, disinfectants, odour masking agents, anti-coating agents and enzymes.

The core or at least part of the cores can be in the form of an encapsulated liquid, preferably in the form of a liquid contained in a gelatin capsule.

According to a further embodiment the core or at least part of the cores is in solid form.

Preferably the core or at least part of the cores has a melting point of more than 35° C., preferably between 55 and 70° C.

The invention also relates to a process for performing a dishwashing cycle in a dishwashing machine, where the composition according to the invention is added at an appropriate time during the prerinsing cycle or main cleaning cycle to the medium in the dishwashing machine.

In a special embodiment of the invention for the case that the basic composition in the form of a tablet is not able, following its dissolving in the medium up to the end of the main cleaning cycle to make available a concentration of the specific compound in the medium which is sufficiently high in order to prevent a significant dissolving of the envelope and a significant detachment of the envelope from the core or cores, said adequate concentration of the specific compound is made available by adding a further composition such as e.g. a machine dishwashing agent composition, to the medium of the main cleaning cycle at an appropriate time.

The composition according to the invention is characterized in that it gives excellent results both in the main cleaning cycle and in the clear rinsing cycle of a dishwashing machine. The basic composition, e.g. in the form of a tablet, is dissolved during the main cleaning cycle and can evolve its corresponding action (cleaning, water softening, washing intensification, etc.). The particle according to the invention contains as the core material the substance or substances evolving their main function in the clear rinsing cycle of the dishwashing machine, e.g. clear rinsing agents.

Said substance or substances are protected by an envelope which, at the concentration of a specific compound, e.g. a specific ion such as OH— ion (and therefore at a specific pH-value) and the temperature of the main cleaning cycle are stable and do not or only insignificantly dissolve or separate. Only when said concentration drops significantly by dilution, i.e. at the start of the clear rinsing cycle, is the solubility of the enveloping material reduced so significantly that it rapidly dissolves or separates and that the active core material is released in the surrounding medium. It is important that the protection of the core material acts from the addition of the inventive composition to the water up to the start of the clear rinsing cycle, i.e. before the cleaning liquor reaches a sufficiently high concentration of the specific compound, as will be explained hereinafter.

As an alternative to the tablet form of the basic composition used in preferred manner, other administration forms are possible and are covered by the protective scope of the invention. Thus, the particles with the envelope changing in the case of a modification of the concentration of the specific compound with respect to its solubility can be connected, e.g. enveloped with the basic composition by a granulation or similar process. In order to ensure for this embodiment an optionally desired, reduced contact between the envelope and the basic composition, the particles can be surrounded by a further protective jacket, which e.g. comprises a water-soluble compound independent of the concentration of the specific compound. With this embodiment during the main cleaning cycle initially the basic composition and protective jacket of the particles are dissolved and once again the particles protected by the inventive envelope are left behind.

Unless special charging or dosing aids are used for charging or dosing, which can retain the particles according to the invention, said particles must be chosen sufficiently large that they do not get discharged to a significant extent during the pumping out following the main cleaning cycle and intermediate rinsing cycle or cycles from the dishwashing machine.

Figure 2:
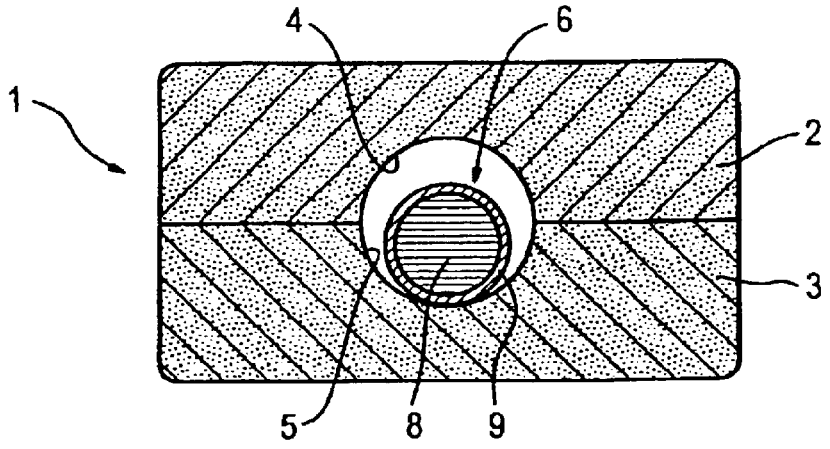
Figure 3:
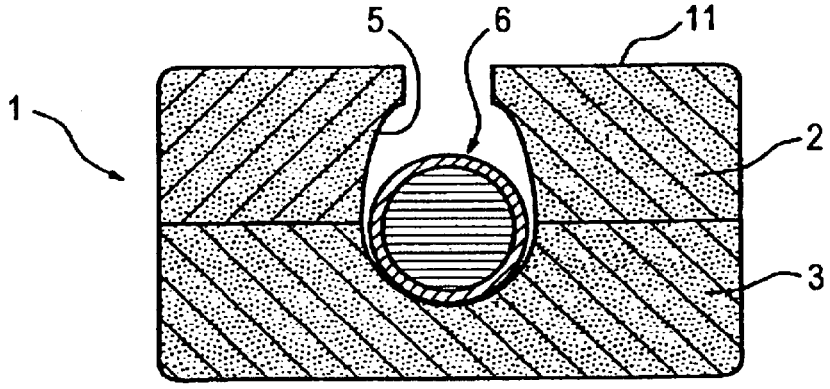
Figure 4:
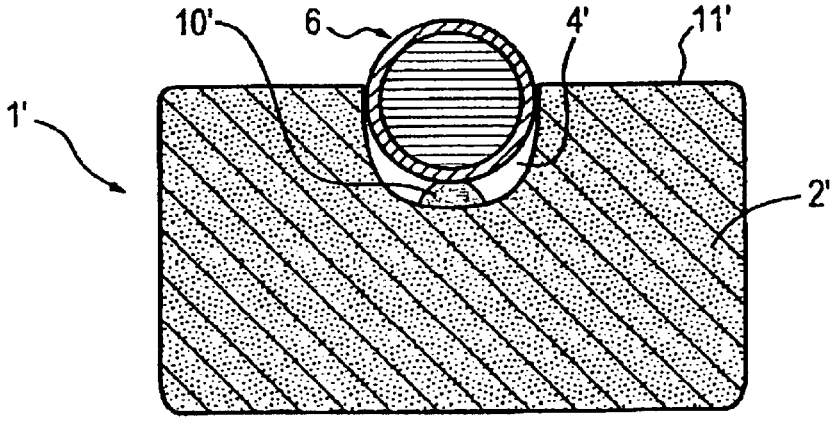
Figure 5A:
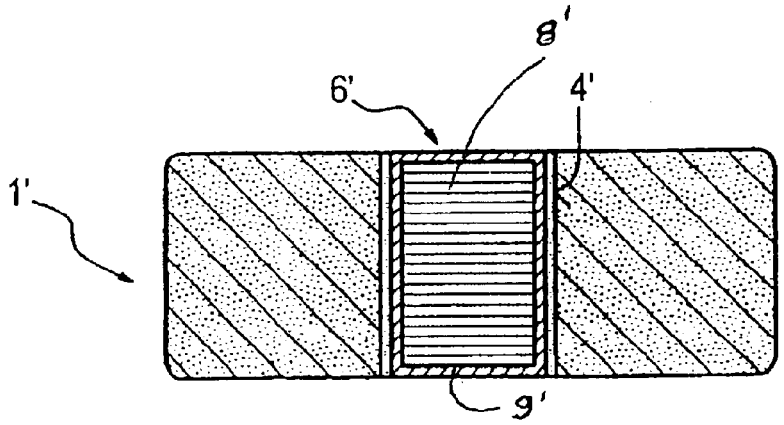
Figure 5B:
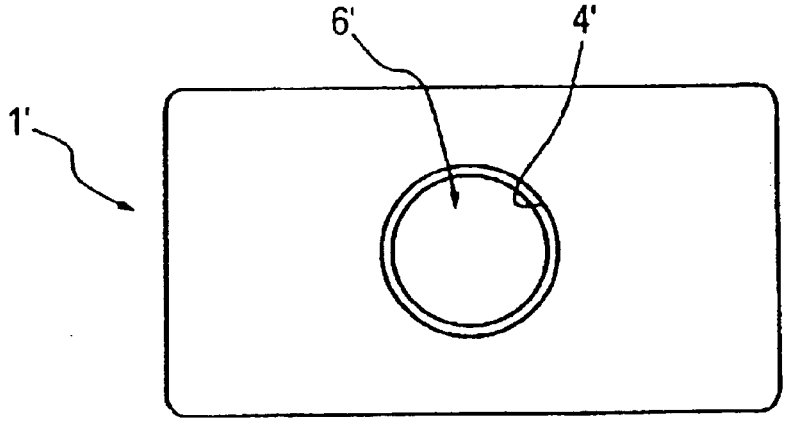
Figure 6:
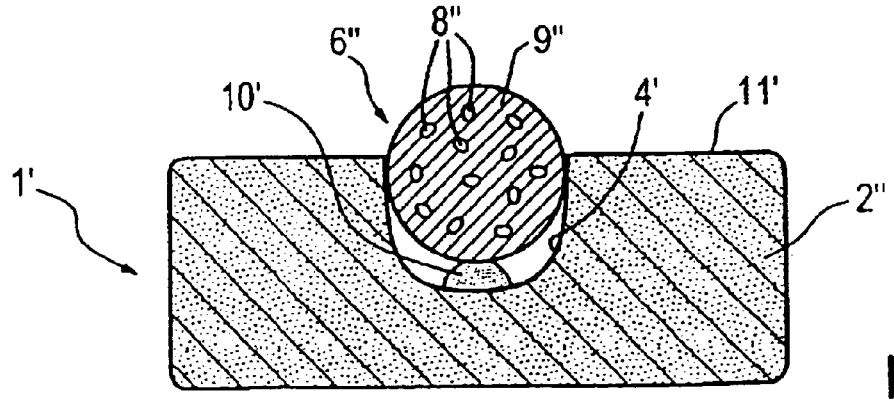

The invention is now described in greater detail by means of the following examples and drawings, wherein show:

| | |
|---|---|
| FIG. 1 | A typical pH-profile of a dishwashing machine. |
| FIG. 2 | A first embodiment of the inventive composition in cross-section. |
| FIG. 3 | A second embodiment of the inventive composition in cross-section. |
| FIG. 4 | A third embodiment of the inventive composition in cross-section. |
| FIGS. 5a and b | A fourth embodiment of the inventive composition in cross-section and in plan view. |
| FIG. 6 | A fifth embodiment of the inventive composition in cross-section. |

The ionic concentration or pH-profiles of the cleaning or rinsing medium in a dishwashing machine are dependent on the ingredients of the cleaning or rinsing agent used. A typical pH-profile when using a conventional, basic machine dishwashing agent, e.g. CALGONIT® can be gathered from FIG. 1 (dishwashing machine used, BOSCH model SMS 3047).

The vertical, broken line subdivision indicates the duration of the following stages: prerinsing, main cleaning, intermediate rinsing, clear rinsing. It is clear that the pH-value during most of the main cleaning cycle is between 10 and 10.5. The pH-value drops following the pumping out of the washing liquor at the end of the main cleaning cycle and the inflow of fresh water to a value of 9 during intermediate rinsing and to between 8.5 and 9 during clear rinsing.

FIGS. 2 to 6 reveal possible embodiments of the composition according to the invention. In all cases the preferred tablet form is chosen for illustration.

FIG. 2 shows a tablet 1 comprising two half-tablets 2 and 3, which can have the same or a different composition. For example it is possible to use a conventional, commercially marketed two-layer tablet, in which the two layers normally have a different composition and have different colours.

Roughly centrally in both half-tablets is provided a roughly hemispherical recess 4 or 5 which, when the tablet 1 is joined together, form a roughly spherical cavity.

In the represented embodiment in said cavity is placed a single particle 6 comprising a core 8 and the envelope 9 and its external diameter is slightly smaller than the internal diameter of the tablet cavity. In another embodiment of the invention particles 6 can also completely fill the complete tablet cavity and engage against the walls thereof. If the internal diameter of the cavity is slightly larger than the external diameter of the particles 6, the particle can either be loosely received in the cavity or fixed therein by an adhesive applied.

In the embodiment where contact between the particle and the surrounding basic composition is to be reduced or completely prevented, the additional advantage arises that during the production process, e.g. the moulding of the individual components in successive stages, a deformation and possibly resulting damage to the core or cores and/or envelope of the core is reliably avoided and which could lead to a reduction in the protective action of the core envelope. By preventing any pressure on the particle during any production process phase, it can reliably also be prevented that for a specific core composition there is no "bleeding" thereof into the material of the envelope and the basic composition. Finally, for specific compositions of the envelope 9 and basic composition 2, 3, it can be advantageous to avoid an intimate, full-surface contact, because otherwise undesired reactions could arise in the boundary layers.

According to a preferred embodiment of the invention, the surface of the particle is at the most only in partial direct contact with the surface of the basic tablet composition surrounding it. This can take place in the manner described in the application, but also in other ways achieving the sought objective. Examples are the loose arrangement of a smaller particle in a larger cavity, the fixing of a smaller particle in the larger cavity in such a way that no or only a partial contact occurs between the particle and the basic composition, the application of a protective coating to the core envelope according to the invention, etc.

The term "local environment", as used in conjunction with a special embodiment of the particle according to the invention, designates the immediate environment around said particle. The concentration of the specific compound in this local environment of the particle is the determining factor for its stability. For the preferred embodiments in tablet form this concentration in the local environment of the particle at least up to a substantially complete dissolving of the tablet is determined by the molecule,passing into solution. Preferably the origin of the "specific compound", at least in the initial phase of the main cleaning process, is a compound from the basic composition forming the tablet or is produced by it in the surrounding medium. In the most typical case with conventional, basic dishwashing agents, it is represented by $OH^-$ ions, whose concentration can be expressed as a pH-value.

If e.g. a basic machine dishwashing agent composition is not used as the basic composition and instead e.g. a water softener composition or a washing intensifier composition, the protection of the particle envelope is possibly only ensured by an adequately high concentration of the specific compound in the local environment of the particle until the basic composition, e.g. the tablet has completely dissolved, namely in the cases where the basic composition is not able to provide a sufficiently high, corresponding concentration in the washing liquor. In these cases the sufficiently high concentration in the washing liquor (and therefore also in the local environment of the particle or particles) is brought about by dissolving the machine dishwashing agent (or a further specific additive).

Obviously not only a conventional adhesive can be used for fixing the particle in the cavity and instead other compositions and agents can be employed which fulfil the same purpose, e.g. a mechanical fixing, such as e.g. adequate frictional engagement between tablet and particle at at least certain points or a plug connection between tablet and particle. It is also possible to use further compounds which melt or dissolve during the main cleaning cycle as fixing agents between the tablet and particle. Obviously for the design of the cavity in the tablet or the particle received therein the most varied further geometrical shapes are possible, such as e.g. an ellipsoid, cylinder, etc. The design and size of the cavity in the tablet and the particle received therein need not correspond to one another. Thus, a cylindrical particle can e.g. be received in a spherical cavity. All possible further combinations can take place within the scope of the present invention. It is also possible to fill the cavity with several smaller particles instead of a single particle.

FIG. 3 shows a second embodiment of the inventive composition based on a conventional two-layer tablet 1. Here the upper half-tablet 3 is in two parts, which make available both an adequate cavity 5 for receiving the particle 6 and also an opening to the tablet side 11. Thus, in this case the particle 6 is not completely surrounded by the basic composition of the tablet 1, so that it is visible from the outside in the interior of the tablet 1. Here again the particle can either be loosely received in the cavity 5 (provided that by a corresponding choice of the size of the particle 6 on the one hand and the size of the opening of the cavity 5 to the tablet side 11 on the other it is ensured that the particle or particles cannot pass through the opening in the cavity) or fixed in the interior of the cavity by corresponding agents, such as e.g. adhesives.

FIG. 4 shows a third possible embodiment. It is based on a unitary tablet 1', i.e. a single layer 2' with a unitary composition and colour. Using a suitable device a depression 4' is formed in said layer 2'. Into the depression 4' is placed the particle 6', which in this case, because the depression to the side 11' of the tablet 1 is only open to the extent that without fixing the particle could drop out of the depression, it is fixed in the depression with an adhesive 10' or a fixing intermediate layer or mechanically (e.g. by frictional engagement). This principle can obviously be transferred to multilayer tablets.

Here again the most varied geometrical configurations are possible. Thus, is the depression e.g. parallel to the side 11' can have a substantially circular cross-section. However a random number of other cross-sections is possible, e.g. any random polygon. The particle 6' received in the depression 4', as in the embodiment of FIG. 3, can assume any random shape (independent of the shape of the depression 4'), such as e.g. an ellipsoid, cylinder, parallelepiped, etc.

It is also possible to fix the particle 6' in a cavity in the tablet open on both sides, such as e.g. in a cylindrical hole 4' passing through the tablet body 1' and in which is fixed a corresponding, cylindrical particle 6' having a core 8' and an envelope 9' (FIGS. 5*a* and *b*).

A further possible embodiment can be gathered from FIG. 6. This is essentially constructed like the embodiment of FIG. 4, i.e. a tablet. 1' having a unitary structure, i.e. formed from a single layer 2" with a unitary composition and colour. However, in the present case the particle 6" not only contains a single core (as in FIG. 4), but a plurality of cores 8" all embedded in an envelope 9". In this embodiment it is e.g. also possible to incorporate into a particle 6" cores having different composition and different shape (encapsulated material or solid cores).

Both in the represented embodiments and further conceivable alternatives it is essential that for the particle containing the substance or substances to be released in the clear rinsing cycle, at least in the first phase of the main cleaning cycle, a local environment exists with an adequate concentration of the specific compound serving as a "trigger" for dissolving the envelope, i.e. in a phase where the concentration is still relatively low, i.e. briefly in a range in which increased solubility of the envelope would exist. This ensures that the envelope has an adequate stability up to the clear rinsing cycle.

EXAMPLE 1

Production of the Core a. Core for a Particle for the Controlled Release of a Clear Rinsing Agent in the Clear Rinsing Cycle The core of the particle or particles, which is only to evolve its activity in the clear rinsing cycle, must incorporate at least one substance acting as a clear rinsing agent. Advantageously in the present invention, use is made of a slightly foaming, nonionic surfactant. Such surfactants are e.g. fatty alcohol ethoxylates, fatty alcohol ethoxylate/propoxylates, ethoxylate/propoxylate polymers, such as e.g. the products of Synperonic® and Brij® range of ICI, the products from the Plurafac®, Pluronic® and Lutensol® range of BASF, the products from the Genapol® range of Clariant and the products from the Poly-tergent® range of Olin.

Other possible examples for such surfactants are alkyl polyglycosides, glucamides and alkyl pyrrolidones. It is obviously possible to use all other surfactants able to evolve the desired action as clear rinsing agents.

Most substances known for use as clear rinsing agents are liquids or wax-like solids. However, in the present invention, a decisive part is not played by the aggregate state of the substance acting as the clear rinsing agent. If liquids are used they can be made available prior to the application of the envelope as surfactant-containing capsules, such as e.g. gelatin capsules or can be brought into an envelopable state by other appropriate measures. Solids can conventionally be directly provided with the envelope and the coating process may have to be matched to the corresponding substance.

For the purposes of the present invention melt mixtures have proved particularly advantageous and supply solid surfactant particles with a melting point above 35° C., preferably between approximately 55 and 70° C.

The combinations given in table 1 of different polyethylene glycols with the surfactants Synperonic® RA30, a block ethylene oxide/propylene oxide, bound to a $C_{13}$–$C_{15}$ alcohol ($C_{13}/C_{15}O(EO)_6(PO)_3$) were produced in the form of melt mixtures as cylinders weighing approximately 0.25 g. Melting point determinations gave the values of table 1.

TABLE 1

| Code | RA 30 [%] | PEG 8000 [%] | PEG 10000 [%] | PEG 20000 [%] | PEG 350000 [%] | melting point [° C.] |
|---|---|---|---|---|---|---|
| C1 | 30 | | 70 | | | 58–63 |
| C2 | 40 | | 60 | | | 57–60 |
| A30 | 50 | | 50 | | | 57–60 |
| A31 | 60 | | 40 | | | 54–58 |
| A30 | 50 | 50 | | | | 57–60 |
| C3 | 60 | 40 | | | | 57–60 |
| C4 | 65 | 35 | | | | 55–59 |
| A33 | 50 | | | 50 | | 59–65 |
| C17 | 60 | | | 40 | | 58–63 |
| C18 | 70 | | | 30 | | 57–64 |
| A34 | 50 | | | | 50 | 59–65 |
| C15 | 60 | | | | 40 | 58–66 |
| C16 | 70 | | | | 30 | 57–64 |

Although all combinations are fundamentally suitable, in particular the 50:50 mixture A33 revealed an excellent stability and was easy to handle, particularly with a view to the subsequent coating process. All samples dissolved rapidly in water, so that in each case an optimum activity as a clear rinsing agent is ensured.

The invention is obviously in no way restricted to the combinations given in exemplified form. As stated, it is possible to use in the present invention any type of surfactant usable as a clear rinsing agent.

b. Core for a Particle for the Controlled Release of a Fragrance in the Clear Rinsing Cycle Bleach-containing, i.e. oxidizing dishwashing agent compositions significantly limit the use possibilities of fragrances usable in such compositions. The controlled release of a fragrance in the clear rinsing cycle would allow a much greater flexibility when using fragrances.

For the controlled release of a fragrance or fragrance composition in the clear rinsing cycle, it is possible to produce a core for a corresponding inventive particle, in that a mixture of 50 wt. % melted polyethylene glycol, e.g. PET 8000, 25 wt. % fragrance or fragrance composition and 25 wt. % diethyl phthalate are cooled in a mould in order to form an e.g. spherical particle weighing e.g. 0.75 g.

c. Core for a Particle for the Controlled Release of an Antibacterial Composition in the Clear Rinsing Cycle The use of an inventive particle with a core or several cores incorporating an antibacterial composition in a tablet for use in a dishwasher would make available the possibility of simultaneously releasing two different compositions in the clear rinsing cycle, namely the antibacterial composition from the core or cores of the particle according to the invention and the clear rinsing agent from the conventional charging device of the dishwasher.

For such a particle a corresponding core is produced in that a mixture of 100% melted benzalkonium chloride (Barquat® MS-100) is cooled in a mould in order to produce an e.g. spherical particle weighing e.g. 0.64 g.

d. Core for a Particle for Controlled Release of Enzymes in the Clear Rinsing Cycle As proteases, which are conventionally used in dishwashing agent compositions, are proved to degrade lipases and therefore can reduce their activity, it would be desirable to incorporate such lipases into the core or cores of a particle according to the invention, so that the lipases would only be released in controlled form in the clear rinsing cycle, which could permit an optimum efficiency of these enzymes.

For this purpose 0.4 g of a granular, lipolytic enzyme (e.g. Lipolase® 100T (Novo)) can be added to a hard gelatin capsule with an e.g. rounded, cylindrical shape, e.g. of the type used for medicaments.

EXAMPLE 2

Screening Process for Enveloping Materials

As stated hereinbefore it is vital for the present invention that the material for enveloping the particle core or cores incorporates the substances evolving their function essentially in the clear rinsing cycle of the dishwasher has a solubility dependent on the concentration of a specific, selected ion. In this way the envelope is substantially insoluble in the main cleaning cycle and is made soluble and is detached from the particle if the concentration decreases during the intermediate rinsing cycle or cycles or the clear rinsing cycle.

It has been observed that the dilution resulting from the pumping out of the washing liquor and the inflow of fresh water during the different rinsing cycles leads to the concentration decreasing 20 to 200 times between the end of the main cleaning cycle and the last rinsing cycle.

On the basis of this observation processes for screening the suitability of different polymers for their use as enveloping materials have been developed consisting of determining the solubility of such polymers at two different concentrations, which differ by at least 20 times and preferably by 200 times.

The values for the concentration, to be used during the screening of the polymers, are dependent on the formulation of the basic composition of the tablet into which the enveloped particle is to be incorporated.

In fact, the value for the highest concentration to be used for the screening process corresponds to the concentration of the selected ion encountered in the washing liquor, after the machine dishwashing agent has completely ok dissolved. Once this concentration has been determined, the lower value for the concentration should be fixed at 20 to 200 times below said higher value. With these details it falls within the routine capacity of an expert in this field to determine the values for the concentration of the test solutions to be used in the different test methods described hereinafter.

Process for the Preparation of the Test Solution and Performing and Evaluating the Test The materials to be investigated are dissolved in solvents in which they are readily soluble. The solutions are spread over glass plates, then dried at ambient temperature until a constant weight occurs.

The glass plates are added at a controlled temperature to a beaker with test solution. The solution is then stirred with a magnetic stirrer at a controlled stirring speed. After about 10 minutes the glass plates are removed from the beaker and dried at ambient temperature to constant weight. The results are expressed as weight loss (%).

Obviously the screening processes must be adapted to the composition of the machine dishwashing agent, because they exert a significant influence on the concentration or pH-profile in the dishwashing cycle. The aim is in each case to check the degree of solubility of the corresponding materials under different states, namely high or low concentration or pH-value.

With this information an average capacity only is required on the part of the expert to draw up specific test parameters for screening. For example, hereinafter two screening processes are described enabling the testing of some of the possible materials for the envelope of the particle according to the invention.

Screening Process 1

Screening process 1 was performed with buffer solutions as the medium for simulating the washing liquor. To this end two buffer solutions were prepared in the following way:

| | |
|---|---|
| Stock solution: | 7.507 g glycine buffer (Merck 104169)<br>5.850 g NaCl<br>topped up with water to 1000 ml |
| pH 8 buffer solution: | 500 ml stock solution<br>500 ml distilled $H_2O$<br>1.23 g of 1 N NaOH |
| pH 10 buffer solution: | 500 ml stock solution<br>500 ml distilled $H_2O$<br>32.6 g of 1 N NaOH. |

Screening Process 2

Screening process 2 was performed with the following cleaning agent formulation in order to simulate the conditions in different stages of a dishwasher cycle. Concentrations of 4 to 5 g/l are of a conventional nature for the cleaning agent load in the washing cycle. Concentrations of approximately 20 to 40 mg/l are of a conventional nature for the clear rinsing cycle.

Cleaning agent formulation

| Ingredient | wt. % |
|---|---|
| Sodium perborate monohydrate | 9.00 |
| Sodium tripolyphosphate | 48.00 |
| Sodium carbonate | 28.00 |
| Polyethylene glycol | 4.00 |
| Polymer | 1.50 |
| TAED | 3.00 |
| Enzyme | 1.50 |
| Surfactant | 3.50 |
| Additive | 1.50 |
| Total | 100.00 |

Screening Process 3

Screening process 3 is used for screening compounds, whose solubility changes as a function of the concentration of potassium ions. The compounds discovered with such a screening process can be used if in the main cleaning cycle, as stated hereinbefore, there is a correspondingly high potassium ion concentration, which must be correspondingly reduced by dilution in the clear rinsing cycle.

Screening process 3 was performed with the following formulation to simulate corresponding conditions.

Formulation

| Ingredient | wt. % |
|---|---|
| Potassium tripolyphosphate | 13.6 |
| Potassium bicarbonate | 34.0 |
| Potassium sulphate | 23.1 |
| Potassium chloride | 12.4 |
| Potassium carbonate | 9.7 |
| Boric acid | 2.0 |
| Sodium perborate monohydrate | 2.0 |
| TAED | 1.0 |
| Paraffin | 1.0 |
| Protease | 0.2 |

Example 3

Selection of Materials for the Particle Envelope

Using the screening processes described in example 2 different materials were tested for their suitability as an envelope for the particle according to the present invention. One of these materials, hereinafter called "polymer 1" is a polymer such as is described in Japanese patent application KOKAI 61-28440, i.e. having the general formula II with 1/(1+m+n)=0.35; m/(1+m+n)=1500–1800.

(II)

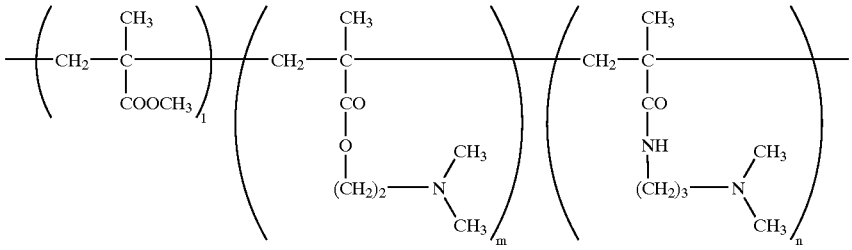

The polymer was produced in the conventional manner by bulk polymerization. The screening test results were as follows:

Screening Process 1

Films of polymer 1 were produced from a 10% solution in isopropanol.

| pH-value of buffer solution | weight loss at 30° C. [%] | weight loss at 60° C. [%] |
|---|---|---|
| 10 | 7–8 | 5–8 |
| 8 | 81–88 | 91–95 |

Screening Process 2

Films of polymer 1 were produced from a 10% solution in a mixture of water and 1 N HCl (17:1).

| Detergent conc. pH-value | Weight loss at 30° C. [%] | Weight loss at 60° C. [%] |
|---|---|---|
| 4 g/l 10.6 | 8–15 | 6–15 |
| 0.02 g/l 8.5 | 90–95 | 89–95 |

The invention is obviously not restricted to this exemplified polymer and naturally a wide variation possibility exists with respect to the polymers referred to in Japanese patent applications KOKAI 60-141705, 61-28440, 61-28441, 61-28596, 61-28597 and 61-28598 and can be extended to compounds of formula IV:

(IV)

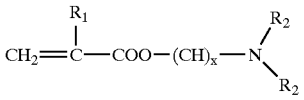

in which $R_1$, independently of one another, is hydrogen or an alkyl group with 1 to 3 carbon atoms, $R_2$, independently of one another, is hydrogen or an alkyl group with 1 to 5 carbon atoms and x is an integer from 1 to 6.

In addition, within the larger class of compounds according to formula III:

(III)

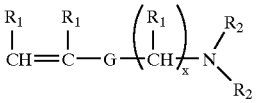

in which G is a linking group selected from —COO—, —OCO—, —CONH—, NHCO—, —NHCONH—, —NHCOO—, —OCONH—or —OCCOO—, $R_1$, independently of one another, is hydrogen or an alkyl group with 1 to 5 carbon atoms and x is an integer from 1 to 6, in exemplified manner polymers can be used having a repeat unit based on a compound of formula V:

(V)

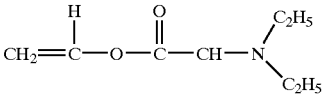

e.g. a pH-sensitive polymer ("polymer 2") with the repeat unit VI, which is commercially obtainable from SANKYO under the trade name AE®, (VI)

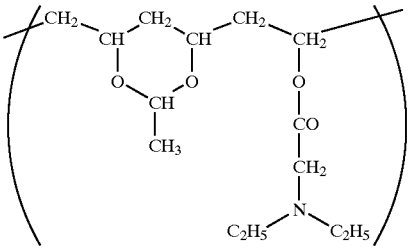

The above-described screening process 2 was also carried out with polymer 2. 15 g of polymer 2 and 5 g of Mowiol® 3-98 (Clariant) were dissolved in 200 ml of a water/ethanol/1 N HCl 12:8:1 mixture. Films were formed and tested in the manner described hereinbefore and the following results were obtained.

| Detergent conc. pH-value | Weight loss at 30° C. [%] | Weight loss at 60° C. [%] |
|---|---|---|
| 4 g/l 10.6 | 2–8 | 5–7 |
| 0.02 g/l 8.5 | 32–40 | 45–47 |

Further polymers having the desired characteristics or which can be easily modified in such a way that they are suitable for the purposes of the present invention are polymers of isomers or derivatives of pyridine. preferably copolymers with styrene or acrylonitrile of formulas VII and VIII, in which G is a substituent at a random point of the pyridine ring.

(VII)

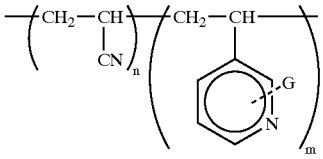

(VIII)

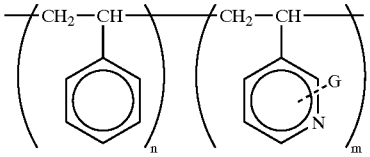

A polymer according to formula VIII, namely poly(4-vinylpyridine styrene) copolymer (Scientific Polymer Products, Inc.) "polymer 3" was tested according to screening process 2. 10 g of polymer 3 were dissolved in 230 ml of water/1 N HCl 6.25:1. The formation of the films and the performance of the tests were in the manner described hereinbefore and the following results were obtained:

| Detergent conc. pH-value | Weight loss at 30° C. [%] | Weight loss at 60° C. [%] |
|---|---|---|
| 4 g/l 10.6 | 0–6 | 5–12 |
| 0.02 g/l 8.5 | 68–85 | 92–94 |

Further polymers are (e.g. random) polymers derived from chitosan, based on the following monomer units IX and X (IX)

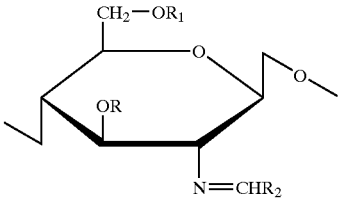

-continued (X)

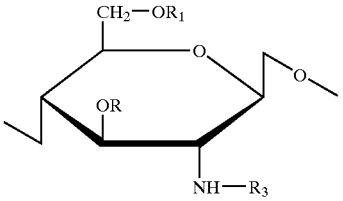

It is also possible to use in the core material envelope substances or substance mixtures which, with regards to their solubility behaviour, react to a change in the ionic concentration, i.e. ionic concentration-sensitive polymers. For this purpose it is e.g. possible to use the partly hydrolyzed polyvinyl acetates (commercially available under the trade names Mowiol®-Clariant) described in EP 284 191 A2 and EP 284 334 A2, which reveal a corresponding ionic concentration dependence in the presence of borates due to the complexing of the borates with polyols. Initial successful tests have been carried out with Mowiol® 56-88.

Another ionic concentration-sensitive polymer is the polysaccharide K-carrageenan, which proved to be in screening process 3 (cf. example 2) a polymer whose solubility is dependent on the potassium ion concentration in the surrounding medium. K-carrageenan is represented by the following formula XI:

(XI)

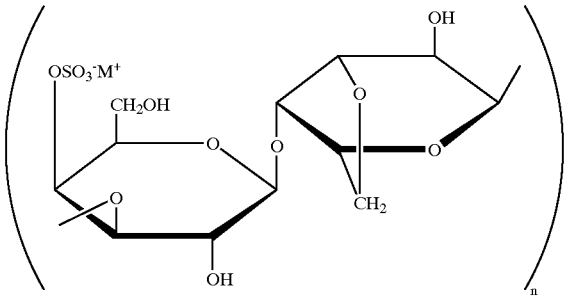

This polymer, called "polymer 4" was tested according to screening process 3. 4 g of K-carrageenan were dissolved in 96 g of water. 10 g of Mowiol® 18-88 were dissolved in 90 g of water and both solutions were mixed. The resulting solution was used for forming films and performing tests in the manner described hereinbefore and the following results were obtained:

| Detergent conc. pH-value | Weight loss at 30° C. [%] | Weight loss at 60° C. [%] |
|---|---|---|
| 4 g/l | 0.5–3.0 | 11.0–12.0 |
| 0.02 g/l | 24.5–25.0 | 78.0–85.0 |

The above list of compounds suitable for the envelope according to the invention is obviously not exhaustive. Further polymers, which change their solubility by a modification of the pH-value or concentration in the desired range are conceivable or can be developed and are consequently covered by the protective scope of the present invention. It is inter alia possible to use for the envelope according to the invention compounds which, with respect to their solubility behaviour, react to a change in the concentration of nonionic compounds in the surrounding medium. The substances suitable for the envelope according to the invention are not limited to polymeric compounds, although such compounds are preferred.

With the aid of the aforementioned screening process or processes, which are adapted to the measurement of an concentration sensitivity, further commercially available materials or those obtainable by easy modifications can be tested for their suitability in the present invention. The choice of such polymers is an easily solved problem for the expert in view of the correspondingly clear aims and the indicated screening processes.

EXAMPLE 4

Production of a Particle According to the Invention

The different cores described in example 1 were used as a basis for the production of particles according to the invention. These cores were individually or in a plurality (FIG. 6) provided with an envelope in a device for the application of a film coating of the type known in the pharmaceutical industry (e.g. obtainable from Lödiger, H üttlin, GS, t adesty and Driam).

In the case where the core or cores have an ingredient revealing a certain incompatibility with the envelope material, prior to the application of said envelope the core or cores can be provided with a protective coating. It is possible to use various prior art materials such as e.g. cellulose, cellulose oderivatives, polyvinyl alcohol, polyvinyl alcohol derivatives and mixtures thereof. Although not prescribed, when using the cores of example 1 such a protective coating was used in all cases and use was made in preferred manner of a 10 wt. % aqueous solution of a polyvinyl alcohol, e.g. the polyvinyl alcohol Mowiol® 5-88 (Clariant). The quantity of the protective coating applied can be varied by the expert as a function of the core composition and correspondingly adapted initial tests have revealed good results with 3 wt. % in case 1*a*, 2 wt. % in case 1*b*, 3 wt. % in case 1*c* and 4 wt. % in case 1*d* of the polymer (dry weight), i n each case based on the weight of the complete particle.

The concentration-sensitive envelope can be applied to the core or cores or the protective coating in any random quantity and thickness, provided that it is ensured that the envelope Is sufficiently rapidly dissolved or detached in the clear rinsing cycle to enable the substance contained therein to evolve its action. In a preferred embodiment to the cores are applied 1 to 10 wt. %, preferably 4 to 8 wt. % of the concentration-sensitive enveloping material (dry weight), based on the total particle weight.

Preferably the size of the inventive particles should be such that they are not or at least not significantly discharged from the dishwasher during the pumping out processes following the main cleaning cycle or intermediate rinsing cycle. Generally a size of max diameter 1 cm is adequate. Larger or smaller dimensions can obviously be chosen, provided that the appropriate operation overall is ensured.

For the further tests "polymer 1" of example 3 was used as the envelope and applied as 10% solution of the polymer in 0.055 N aqueous HCl.

EXAMPLE 5

Production of a Two-layer Dishwashing Agent Tablet with Clear Rinsing Agent Particles A typical two-layer dishwashing agent tablet suitable for receiving a clear rinsing agent particle in the cavity formed therein in accordance with the present invention, can be produced by moulding the pulverulent ingredients in prior art machines and using operating parameters known from the prior art. One possible tablet shape is a parallelepipedic tablet formed from two substantially equally thick layers and in the largest surface of each of these layers is formed a hemispherical recess, so that on joining together the two half-tablets a substantially spherical cavity is formed in the interior (cf. FIG. 2).

The composition of the dishwashing agent tablet is based on commercially available products. An exemplified composition can be gathered from table 2. It is obviously possible to use other compositions, particularly those optimized for supporting the compound surrounding the core (e.g. in the provision of alkalinity).

TABLE 2

| | White layer 50% | Coloured layer 50% |
|---|---|---|
| Sodium perborate monohydrate | 18.00 | |
| Sodium tripolyphosphate | 48.00 | 48.00 |
| Sodium carbonate | 24.00 | 32.00 |
| Polyethylene glycol 6000 | 3.00 | 5.00 |
| Polymer | | 3.00 |
| TAED | | 6.00 |
| Enzyme | | 3.00 |
| Dye | | 0.02 |
| Surfactant | 4.50 | 2.50 |
| Additive | 2.50 | 0.50 |
| | 100.00 | 100.00 |

For the tests performed in examples 6 and 7 half-tablets weighing approximately 11.5 g were produced. The cavity resulting from the joining of the half-tablets had an internal diameter of approximately 1.2 cm.

The clear rinsing agent particle produced according to examples 1a and 4 is placed in a hemispherical recess of the white or coloured half-tablet. Subsequently a fixing substance, e.g. an adhesive (e.g. polyethylene glycol, polyvinyl ether, polyvinyl alcohol, silicate, preferably melted PEG 4000) is applied to the corresponding half-tablet surface and optionally the clear rinsing agent particle and the second half-tablet (coloured or white) is pressed onto the first half-tablet with clear rinsing agent particle.

EXAMPLE 6

This example describes a test proving the transfer of the clear rinsing agent surfactant into the clear rinsing cycle using the tablet produced according to example 5.

The clear rinsing agent particles have an average surfactant or polyethylene glycol content of in each case approximately 0.37 g. The average water quantity in the clear rinsing cycle is approximately 5 litres. The expected maximum quantity of surfactant plus PEG in the clear rinsing cycle should therefore be 0.148 g/l when using one tablet per rinsing cycle.

In each case three different tests were performed with three different tablets in a BOSCH SMS 3047 dishwasher. The water hardness was approximately 17° dH.

1. Dishwashing agent tablet without clear rinsing agent particles; temperature 65° C.

2. Dishwashing agent tablet with clear rinsing agent particles (example 6); temperature 65° C.

3. Dishwashing agent tablet with clear rinsing agent particles (example 6); temperature 55° C.

In each test a minimum of 1 litre of washing liquor was removed from the clear rinsing cycle shortly before the water was drained. The samples were designated 1.1 to 3.3. The liquor was then analyzed in order to detect the total quantity of surfactant plus polyethylene glycol in the clear rinsing cycle. The measurements were performed in that the surfactant and PEG were extracted, the solvent evaporated and a gravimetric determination of the nonvolatile residue was performed.

It is pointed out that with this analytical method both the nonionic surfactant and the polyethylene glycol can be established.

TABLE 3

| | Test 1 mg/l | (n = 1) % | Test 2 mg/l | (n = 2) % | Test 3 mg/l | (n = 3) % |
|---|---|---|---|---|---|---|
| n.1 | 1.0 | | 43.6 | 29.5 | 91.9 | 62.1 |
| n.2 | 10.4 | | 48.8 | 33.0 | 64.2 | 43.4 |
| n.3 | 7.0 | | 32.7 | 22.1 | 76.5 | 51.7 |

EXAMPLE 7

The test described in this example is used for testing the composition according to the invention for effectiveness in the clear rinsing cycle.

For comparison with the inventively produced dishwashing agent tablet with clear rinsing agent particles, as produced in example 6, the clear rinsing efficiency of separately added dishwashing agent and clear rinsing agent was investigated. The dishwashing agent corresponded to the composition of the tablet according to the invention and a commercial clear rinsing agent was used. A BOSCH SMS 3047 dishwasher was used. The water hardness was approximately 17 to 19° H. The temperature was 65° C. The dishwasher was loaded with 20 glasses, 20 black porcelain plates and 20 cutlery items.

The dirtying of the dishwasher load was carried out in the following way. 50 g of minced meat (pork:beef 1:1) were roast with 2 g of fat. After reaching a slightly brownish colour, to the meat was added a gravy containing 100 ml of water, 1 g of gravy binder and 2.5 g of instant gravy.

This material was added to the dishwasher, the screen being closed by a plug in order to have the dirtying action in the machine up to the end of the washing program. The dishwashing agent was fed in at the start of the clear rinsing cycle. The dishwasher load was evaluated 10 minutes after the end of the dish rinsing cycle.

Visual evaluation was based on the following:

4 points=no marks 3 points=1 to 4 marks 2 points=more than 4 marks up to ¼ of the surface covered with marks 1 point=¼ to ¼ the surface covered with marks 0 point=almost completely covered with marks.

The mark or spot prevention efficiency is expressed as a percentage, 100% efficiency representing the maximum number of 228 points. The results are given in table 4.

TABLE 4

| | Efficiency | | |
|---|---|---|---|
| | Cleaning agent + 2 ml of clear rinsing agent | Cleaning agent + 3 ml of clear rinsing agent | Tablet with clear rinsing agent particles |
| Porcelain | 66.9 | 75.6 | 96.9 |
| Glass | 25.6 | 26.9 | 49.4 |
| Cutlery | 80.6 | 90.6 | 78.8 |
| Total | 57.7 | 64.4 | 75.0 |

The results reveal an excellent clear rinsing agent of the composition according to the invention. This was particularly marked with porcelain and glass, the efficiency in the case of table cutlery being comparable with that of conventional compositions. Surprisingly there was in part superior clear rinsing efficiency of the inventive composition compared with the conventional procedure of separately adding dishwashing agent and clear rinsing agent.

The features of the invention disclosed in the above description, the claims and the drawings can be essential to the implementation of the invention in its different embodiments, both singly and in random combination.

What is claimed is:

1. A composition for use in a dishwashing machine, comprising a tablet composition comprising an ionic compound which deploys its function in a main cleaning cycle of the dishwashing machine, a particle having a core, the particle incorporating a substance intended to perform its function during a rinsing cycle of the dishwashing machine, and an envelope surrounding the core, the envelope comprising a compound whose solubility is inversely proportional to a concentration of the ionic compound in a surrounding medium, wherein the particle is arranged in or on the tablet such that only a portion of a surface of the particle directly contacts the tablet, wherein the concentration of the ionic compound caused by dissolution of the tablet in the main cleaning cycle is sufficiently high to prevent dissolution of the envelope or detachment of the envelope from the particle core.

2. The composition according to claim 1, in which the particle is coated with a substance which, independently of the concentration of the ionic compound in the surrounding medium, dissolves or separates from the particle during the main rinsing cycle of the dishwashing machine.

3. The composition according to claim 1, in which the particle is received in a cavity of the tablet wherein the cavity surrounds the particle.

4. The composition according to claim 3, in which the particle has a same volume as the cavity.

5. The composition according to claim 3, in which the cavity has a larger volume than the particle contained therein.

6. The composition according to claim 5, in which the particle is loosely arranged in an interior of the cavity.

7. The composition according to claim 5, in which the particle is fixed in an interior of the cavity.

8. The composition according to claim 7, in which the particle is fixed by an adhesive.

9. The composition according to claim 3, in which the cavity is substantially centrally positioned in an interior of the tablet.

10. The composition according to claim 9, in which the tablet has a single spherical cavity.

11. The composition according to claim 10, in which the cavity contains a single spherical particle whose diameter is less than an internal diameter of the cavity.

12. The composition according to claim 1, in which the particle is received in a cavity of the tablet, wherein the cavity only partly surrounds the particle.

13. The composition according to claim 1, in which the particle is received in a depression in a surface of the tablet.

14. The composition according to claim 12, in which the particle is placed in the cavity in such a way that it does not project beyond the surface of the tablet.

15. The composition according to claim 13, in which the particle is placed in the depression in such a way that it does not project beyond the surface of the tablet.

16. The composition according to claim 14, in which the cavity contains a single particle, whose volume equals that of the cavity.

17. The composition according to claim 16, in which the cavity has a circular mouth.

18. The composition according to claim 17, in which the mouth of the cavity is smaller than a diameter of the particle received therein.

19. The composition according to claim 18, in which the particle is loosely arranged in the cavity.

20. The composition according to claim 18, in which the particle is fixed in the cavity.

21. The composition according to claim 20, in which the particle is fixed by an adhesive.

22. The composition according to claim 1, in which the tablet comprises a composition selected from the group consisting of a machine dishwashing agent composition, a water softener composition, a washing intensifier composition, and combinations thereof.

23. The composition according to claim 1, in which the envelope incorporates a compound which at the concentration of the ionic compound, at the end of the main cleaning cycle of the dishwashing machine, is insoluble or only slightly soluble and, at a concentration of the ionic compound in the clear rinsing cycle, the envelope compound has an adequate solubility to ensure that it is dissolved or detached from the core such that release of the core material into a medium of the clear rinsing cycle is possible.

24. The composition according to claim 23, in which a solubility of the envelope compound is inversely proportional to OH-ionic concentration in the surrounding medium.

25. The composition according to claim 24, wherein at a pH-value above 10 the envelope compound has no or only a limited solubility and at a pH-value below 9 has a solubility such that it becomes dissolved or detached from the particle core.

26. The composition according to claim 23, in which the envelope compound comprises a polymer.

27. The composition according to claim 26, in which the envelope compound comprises a pH-sensitive polymer incorporating a repeat unit having a basic function which does not form part of a backbone chain of the polymer.

28. The composition according to claim 27, in which the repeat unit is based on a compound selected from the group consisting of vinyl alcohol derivatives, acrylates and alkyl acrylates having the basic function.

29. The composition according to claim 27, in which the polymer is carbohydrate functionalized with the basic function.

30. The composition according to claim 27, in which the basic function is an amine.

31. The composition according to claim 30, in which the amine is a secondary or tertiary amine.

32. The composition according to claim 30, in which the repeat unit is based on a compound of formula III:

(III)

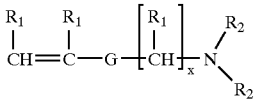

in which

G is a linking group selected from —COO—,—OCO—, —CONH—,—NHCO—,—NHCONH—,—NHCOO—,—OCONH—or—OCOO—, each $R_1$ is hydrogen or an alkyl group with 1 to 3 carbon atoms, each $R_2$ is hydrogen or an alkyl group with 1 to 5 carbon atoms, and x is an integer from 1 to 6.

33. The composition according to claim 32, in which the repeat unit is based on a compound of formula IV:

(IV)

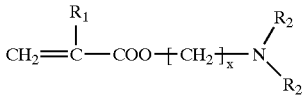

in which $R_1$ hydrogen or an alkyl group with 1 to 3 carbon atoms, each $R_2$ is hydrogen or an alkyl group 1 to 5 carbon atoms, and x is an integer from 1 to 6.

34. The composition according to claim 27, in which the basic function is an imine.

35. The composition according claim 27, in which the basic function is a basic aromatic N-containing group.

36. The composition according to claim 35, in which the basic function is a pyridine group.

37. The composition according to claim 35, in which the basic function is an imidazole group.

38. The composition according to claim 24, in which the polymer is derived from chitosan.

39. The composition according to claim 24, in which the composition incorporates k-carrageenan.

40. The composition according to claim 1, in which the core incorporates a material selected from the group consisting of surfactants, antibacterial compositions, silver protection agents, fragrances, bleaches, disinfectants, odor masking agents, anti-coating agents, enzymes, and combinations thereof.

41. The composition according to claim 40, in which the core is in a form of an encapsulated liquid.

42. The composition according to claim 41, in which the encapsulated liquid is contained in a gelatin capsule.

43. The composition according to claim 40, in which the core is in solid form.

44. The composition according to claim 1, in which the core has a melting point higher than 35° C.

45. The composition according to claim 44, in which the core has a melting point between 55° C. and 70° C.

46. A process for washing dishes in a dishwashing machine, which comprises introducing into the dishwashing machine a composition comprising a tablet composition comprising an ionic compound which deploys its function in a main cleaning cycle of the dishwashing machine, a particle having a core, the particle incorporating a substance intended to perform its function during a cycle of the dishwashing machine, and an envelope surrounding the core, the envelope comprising a compound whose solubility is inversely proportional to a concentration of the ionic compound in a surrounding medium, wherein the particle is arranged in or on the tablet such that only a portion of a surface of the particle directly contacts the tablet, wherein the concentration of the ionic compound caused by dissolution of the tablet in the main cleaning cycle is sufficiently high to prevent dissolution of the envelope or detachment of the envelope from the particle core.

47. The process according to claim 46, comprising an additional step of introducing an additional dishwashing agent into said dishwashing machine.

* * * * *